US005444958A

United States Patent [19]

Lu

[11] Patent Number: 5,444,958

[45] Date of Patent: Aug. 29, 1995

[54] DOOR FRAME

[76] Inventor: Ching-Nan Lu, No. 16, Lane 83, Tzu-Chiang-I Rd., Chien-Chin Dist., Kaohsiung City, Taiwan

[21] Appl. No.: 144,429

[22] Filed: Nov. 2, 1993

[51] Int. Cl.[6] ..... E06B 1/30

[52] U.S. Cl. ..... 52/775; 52/204.67; 52/204.7; 52/771

[58] Field of Search ..... 49/501; 52/204.55, 204.56, 52/204.62, 204.64, 204.67, 204.7, 204.72, 204.65, 204.71, 213, 217, 770, 771, 775, 780, 781, 822, 823, 824, 825

[56] References Cited

U.S. PATENT DOCUMENTS

| | | | |
|---|---|---|---|
| 3,040,847 | 6/1962 | Webster | 52/204.7 X |
| 3,081,849 | 3/1963 | Hubbard | 52/204.7 X |
| 3,789,564 | 2/1974 | Kessler | 52/204.62 X |
| 4,235,049 | 11/1980 | Marinoni et al. | 52/825 X |
| 4,655,025 | 4/1987 | Marinoni | 52/825 X |
| 4,914,888 | 4/1990 | Hanson | 52/823 X |
| 4,939,868 | 7/1990 | Lu | 49/388 |
| 4,947,597 | 8/1990 | Simpson | 52/397 X |
| 5,069,010 | 12/1991 | Trainor, Jr. et al. | 52/825 X |

FOREIGN PATENT DOCUMENTS

| | | | |
|---|---|---|---|
| 1167322 | 5/1984 | Canada | 52/204.62 |

*Primary Examiner*—Carl D. Friedman
*Assistant Examiner*—Kevin D. Wilkens
*Attorney, Agent, or Firm*—Oblon, Spivak, McClelland, Maier & Neustadt

[57] ABSTRACT

An H-shaped frame is divided into a first and second guide channel by a partition plate and has a panel holder received in the second guide channel. The panel holder includes two clamping plates, each of which has a joining portion and a clamping portion that define cooperatively a space therebetween to receive an edge of a flat panel. A first engaging unit is formed on external surface of the clamping portion. The second guide channel has a second engaging unit which engages the first engaging unit when the panel holder is inserted slidably into the second guide channel.

6 Claims, 5 Drawing Sheets

DOOR FRAME

BACKGROUND OF THE INVENTION

1. Field of the Invention

The invention relates to a door frame, more particularly to a door frame which incorporates means for detachable holding a glass panel.

2. Description of the Related Art

FIG. 1 shows a conventional door frame which is to be mounted at horizontal top and bottom edges of a glass panel 1 for mounting the glass panel 1 between a pair of fixing seats 50 which are fixed respectively to the top and bottom ends of a wall opening adjacent to one side of the latter, as illustrated in FIG. 2.

FIG. 3 shows a cross sectional view of the conventional door frame which includes a frame member 10, a slide piece 20 provided in the frame member 10, a cover 15 mounted to one side of the frame member 10 and a connecting member 30 mounted in the frame member 10. The frame member 10 has an H-shaped cross section defined by a pair of vertically-oriented side plates 102 which are interconnected by a horizontally-oriented partition plate 101 to form first and second guide channels 12, 13 on opposite sides of the partition plate 101. The first guide channel 12 has two opposed flanges 121 protruding inwardly from inner surfaces of the side plates 102 along the length of the frame member 10. A long opening 122 is formed between the opposing flanges 121. In this respect, the first guide channel 12 of the frame member 10 is divided into a first channel portion 124 in which the connecting member 30 is mounted, and a second channel portion 125 for receiving the slide piece 20. In addition, each of the flanges 121 has a long groove 123 formed in the bottom side thereof, while the slide piece 20 has two long ridges 201 projecting therefrom so as to slidably engage the ridges 201 in the grooves 123. The slide piece 20 also has an arcuate member 202 integrally formed on the upper portion thereof parallel to the length of the long protrusion 201. The cover 15 has two wing members 151 which clamp respectively the vertical plates 102 of the frame member 10.

The slide piece 20 is provided slidably in the second channel portion 125 with the protrusions 201 fitting into the grooves 123 of the guide rails 121. The connecting member 30 is placed on the flanges 121 in the first channel portion 124 of the frame member 10. Two screws 9 respectively pass through the side ends of the connecting member 30, the opening 122 and into the arcuate member 202 of the slide piece 20 so as to interconnect the connecting member 30 and the slide piece 20, thus immobilizing the slide piece 20.

After the slide piece 20 is connected to the connecting member 30 and is immobilized by the screws 9, the connecting member 30 may be attached to a mounting plate 40, and the mounting plate 40 may be engaged to a pivot pin 51 of the fixing seat 50 which is fixed in the wall in a conventional manner.

During mounting operation of the door, if the relative positions of the mounting plate 40 and the pivot pin 51 of the fixing seat 50 are incorrect, the pivot pin 51 is prevented from engaging with the mounting plate 40. The user releases the screws 9 so as to move the slide piece 20 and the connecting member 30 to a predetermined position in which the mounting plate 40 and the pivot pin 51 of the fixing seat 50 may properly engage each other. The screws 9 are then operated to immobilize the slide piece 20. Note that the screws 9 are screwed to the slide piece 20 from the first channel portion through the connecting member 30. The conventional fixing screws for connecting the frame member 10 and the connecting member 30 are screwed to the latter from the second guide channel 13 of the frame member 10 and are sealed in the silicon rubber, thereby preventing release of the same for adjusting purposes. Therefore, only the screws 9 can be conveniently released for adjusting.

A main drawback of the conventional door frame is that it is difficult to install the glass panel 1 in the second guide channel 13 of the frame member 10. In order to position the horizontal top and bottom edges of the glass panel 1 properly in the second guide channels 13 of the frame members 10, a double-sided adhesive tape or silicon rubber glue must be provided on inner surfaces of the side plates 102 in the second guide channel 13. During the time which is necessary to cure the silicon rubber glue, the glass panel 1 must be held manually so as to align the same with the side plates 102, thereby inconveniencing the operator. Any movement of the glass panel 1 may lead to misalignment of the same relative to the side plates 102 of the frame member 10.

Furthermore, in the event that the glass panel 1 is broken or is to be replaced with a new or different kind of panel, such as an aluminum panel, it is difficult to disassemble the glass panel 1 from the frame members 10.

SUMMARY OF THE INVENTION

Therefore, a main objective of the present invention is to provide a door frame which incorporates means for holding detachably a glass panel at the second guide channel thereof to facilitate assembly of the glass panel.

The door frame of the present invention is generally similar to the conventional door frame described in the preceding paragraphs. The present invention, however, further includes a panel holder that has a first engaging unit, and a second engaging unit that is formed at the second guide channel and that is capable of engaging the first engaging unit when the panel holder is inserted into the second guide channel.

In one preferred embodiment, the panel holder includes two clamping plates, each of which being provided with a joining portion and a clamping portion. Each of the clamping plates has a pair of spaced mounting holes formed through the joining portion. The clamping portions of the clamping plates cooperatively define a panel receiving space therebetween when the clamping plates are clamped together by means of fastening screws. One of the clamping plates has a first abutting flange formed along and adjacent to the topmost edge of the joining portion, and a second abutting flange formed on the joining portion below and parallel to the first abutting flange. The second abutting flange has a width that is narrower than that of the first abutting flange. The first engaging unit includes two pairs of opposed first ribs formed on external surfaces of the clamping portions and a pair of extra ribs formed along the longitudinal edges of the clamping portions. Each extra rib has an abutting face which is exposed to an exterior of the second guide channel and an elongated groove formed therein. The second engaging unit includes two pairs of opposed second ribs which are formed on inner surfaces of two side plates that define the second guide channel and which are parallel to the partition plate. The second engaging unit further includes a pair of engaging ribs extending into the second guide channel from the longitudinal edges of the side plates. Each of the engaging ribs has an elongated protrusion which extends into the groove of one of the extra ribs when the panel holder is slidably inserted into the second guide channel, thereby preventing the untimely removal of the panel holder.

Since the panel holder in this invention can be detachably inserted, installation of a glass panel in the second guide channel of the door frame can be facilitated.

BRIEF DESCRIPTION OF THE DRAWINGS

Other features and advantages of the present invention will become more apparent in the following detailed description of the preferred embodiment of the present invention with reference to the accompanying drawings, in which.

DESCRIPTION OF THE PREFERRED EMBODIMENT

Figure 1:
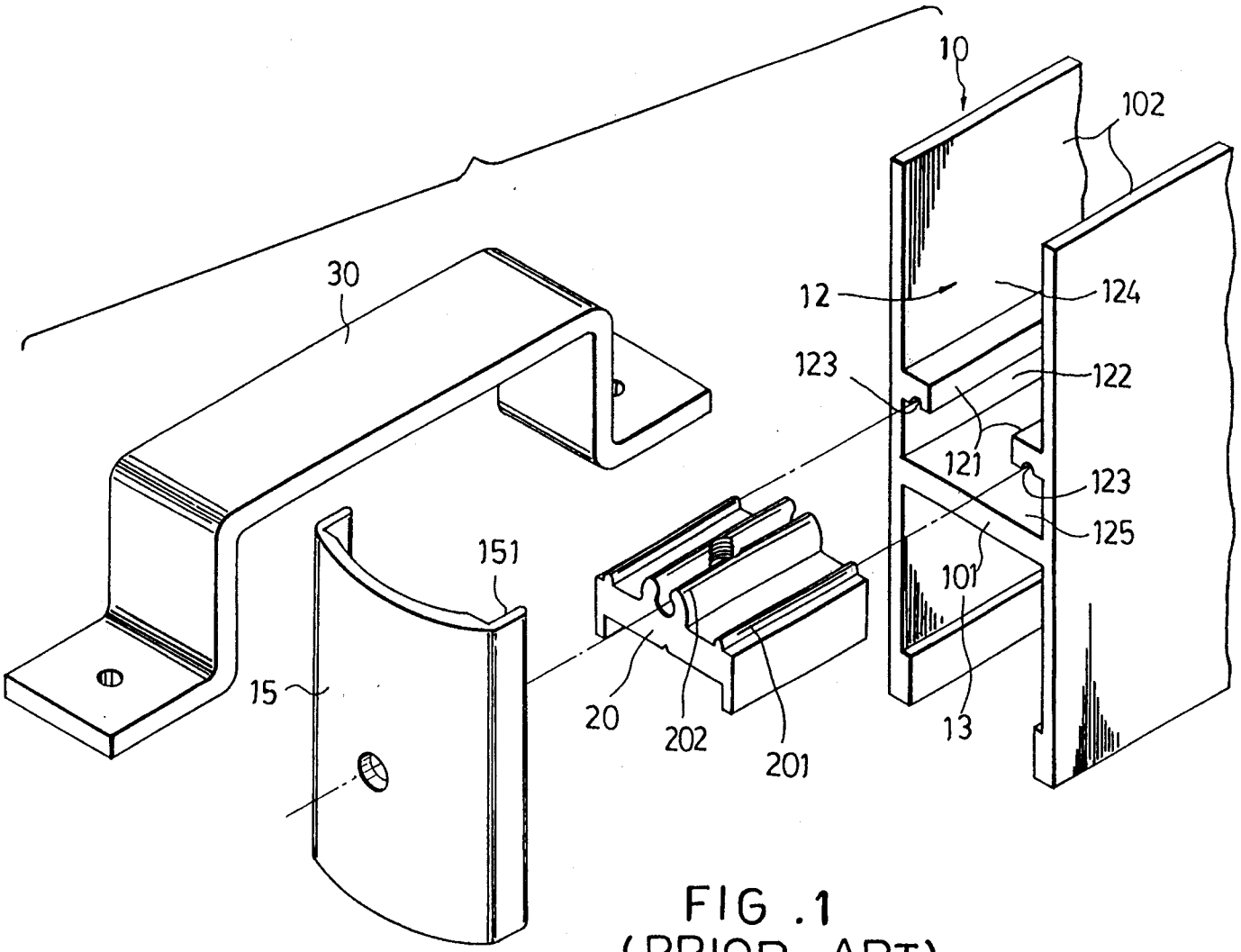
FIG. 1 (PRIOR ART)
FIG. 1 shows an exploded view of a conventional door frame.

Before the present invention is described in greater detail, it should be noted that like elements are indicated by the same reference numerals throughout the disclosure.

Figure 3:
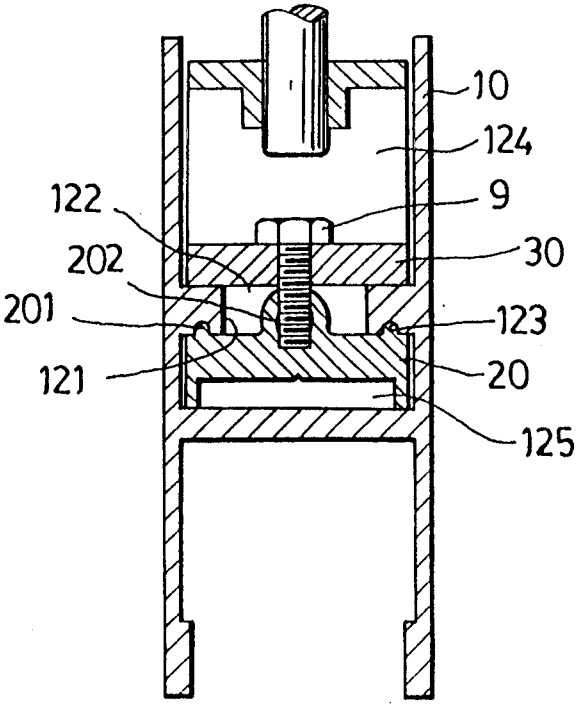
FIG. 3 (PRIOR ART)
FIG. 3 shows a cross sectional view of the conventional door frame.
Figure 4:
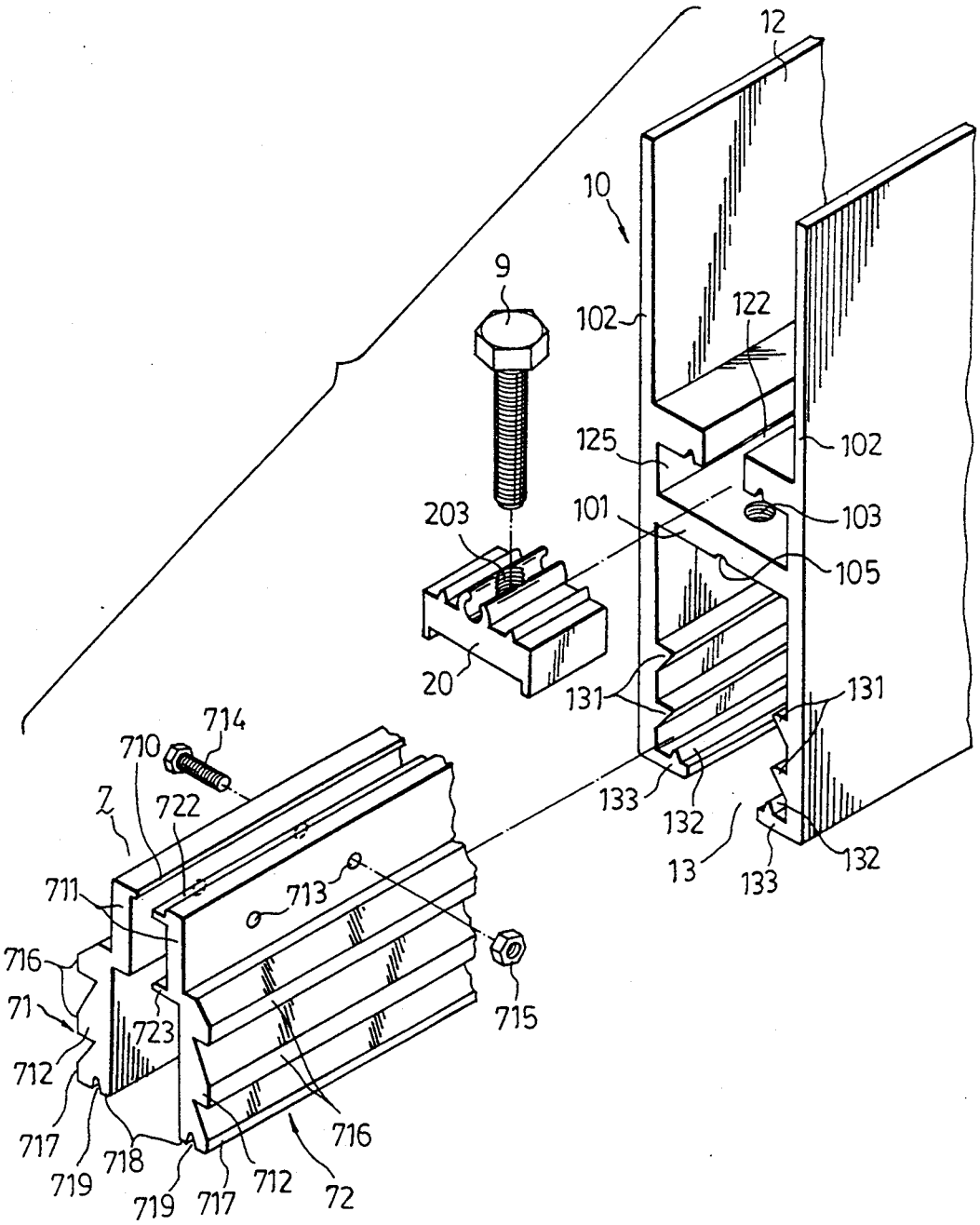
FIG. 4 illustrates an exploded view of the door frame of the present invention.
Figure 7:
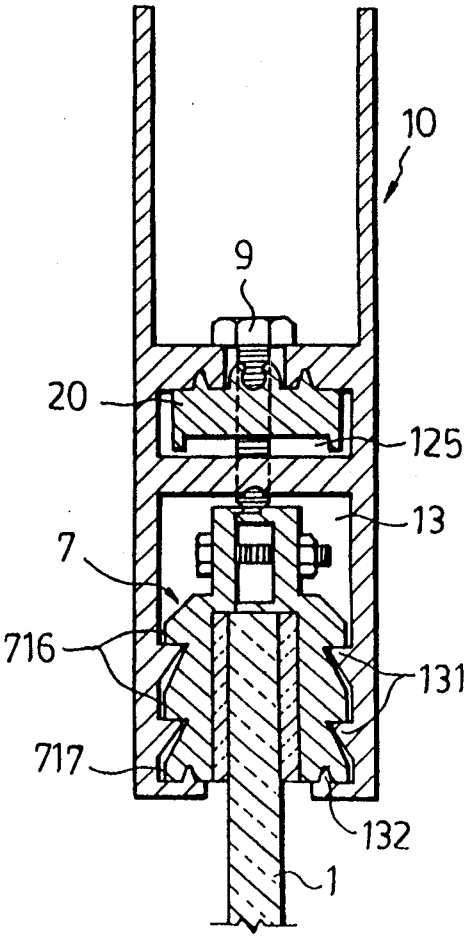
FIG. 7 illustrates a cross sectional view of the door frame of the present invention, when used to hold a glass panel.
Figure 6:
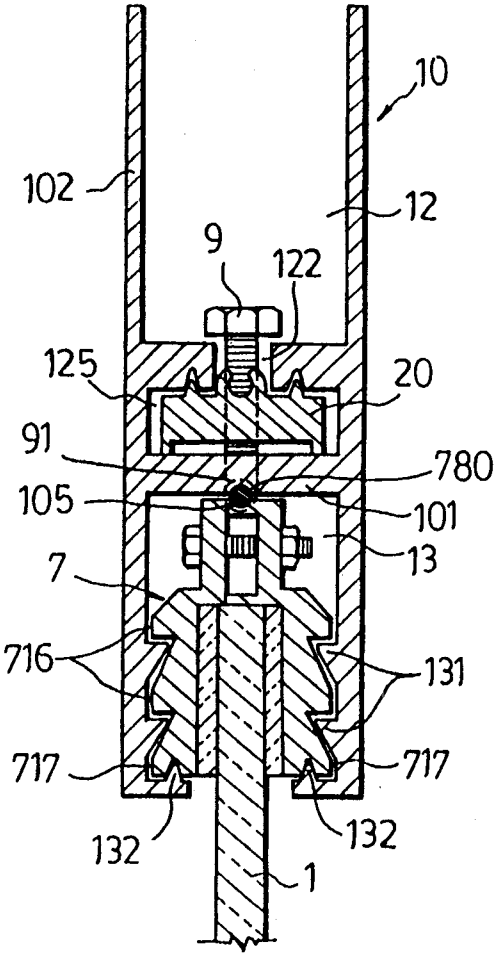
FIG. 6 illustrates a cross sectional view of the door frame of the present invention, before the glass panel is tightly clamped by the panel holder of the door frame.
Figure 5:
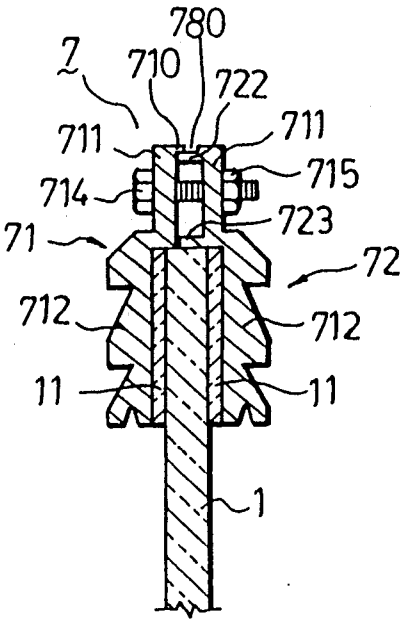
FIG. 5 shows a panel holder of the door frame of the present invention when holding a glass panel.

Referring to FIGS. 4 and 5, the door frame of the present invention includes an H-shaped frame member 10 with two side plates 102 and a partition plate 101 which divides the side plates 102 into a first guide channel 12 and a second guide channel 13 on opposite sides of the partition plate 101. Since the first guide channel 12 is similar to that of the conventional door frame shown in FIGS. 1 to 3, a description of its construction is omitted.

The partition plate 101 of the frame member 10 further includes an elongated groove 105 formed therein in the second guide channel 13, the purpose will be described latter, a panel holder 7 with a first engaging unit formed thereon, and a second engaging unit provided in the second guide channel 13 for engaging the first engaging unit so as to retain the panel holder 7 in the second guide channel 13.

The panel holder 7 includes first and second clamping plates 71, 72 located side by side. Each of the clamping plates 71, 72 has a joining portion 711, a clamping portion 712, and a plurality of mounting holes 713 which are formed through the joining portion 711. The first clamping plate 71 has a retaining flange 710 formed along a topmost edge thereof. The second clamping plate 72 includes an elongated first abutting flange 722 with a flange width that is wider than that of the retaining flange 710. The first abutting flange 722 is formed adjacent to and along the topmost edge of the joining portion 711. A second abutting flange 723 is also formed on the joining portion 711 of the second clamping plate 72 and is located below and parallel to the first abutting flange 722. The second abutting flange 723 has a width that is slightly narrower than that of the first abutting flange 722, the purpose of which will be described in the succeeding paragraphs. The first and second clamping plates 71, 72 cooperatively define a panel receiving space between the clamping portions 712 when the clamping plates 71, 72 are clamped together at the joining portions 711. The receiving space is substantially equal to the thickness of the glass panel 1.

The first engaging unit includes two pairs of opposed first ribs 716 formed on external surfaces of the clamping portions 712 and a pair of extra ribs 717 formed along the longitudinal edges of the clamping portions 712. Each of the extra ribs 717 has an abutting face 718 that faces an exterior portion of the panel receiving space and is provided with an elongated groove 719. The second engaging unit includes two pairs of opposed second ribs 131 formed on inner surfaces of the side plates 102 that define the second guide channel 13, and a pair of engaging ribs 133 which extend inwardly from the side plates 102 and which are provided with elongated protrusions 132 that fit into the grooves 719 of the extra ribs 717 when the panel holder 7 is slidably inserted in the second guide channel 13 of the frame member 10. It is important to note that each of the first and second ribs 716, 131 has a horizontal flat face and an inclined face which are formed in such a manner that they match when the panel holder 7 is inserted slidably into the second guide channel 13. Note that when the clamping plates 71, 72 are at a clamped position, the first and second abutting flanges 722, 723 of the second clamping plate 72 abut against the joining portion 711 of the first clamping plate 71 so that an elongated groove 780 is formed between the retaining flange 710 and the topmost edge of the joining portions 711 of the second clamping plate 72, the purpose of which will be described in the following paragraphs.

Referring to FIG. 5, when mounting the panel holder 7 on one horizontal edge of the glass panel 1, a double-sided adhesive tape 11 is provided on the inner surfaces of the clamping portions 712 of the clamping plates 71, 72, respectively. The second clamping plate 72 is held incline with respect to the vertical glass panel 1 such that the second abutting flange 723 of the second clamping plate 72 is placed on the top edge of the glass panel 1 while the clamping portion 712 of the same is pivoted so as to press against one side of the glass panel 1. Then, the retaining flange 710 of the first clamping plate 71 is placed on the first abutting flange 722 of the second clamping plate 72, while the clamping portion 711 of the same is pivoted toward the second clamping plate 72 in order to press against the other side of the glass panel 1. A plurality of locking screws 714 are inserted through the mounting holes 713 of the clamping plates 71, 72 to fasten the locking unit 715. When the screws 714 are tightened to a certain extent, the clamping portions 712 move toward one another so as to clamp the glass panel 1 therebetween. The screws 714 can be tightened further so that the second clamping plate 72 pivots relative to the first abutting flange 722 until the second abutting flange 723 abuts against the joining portion 711 of the first clamping plate 71, thereby clamping the glass panel 1 firmly therebetween to prevent removal of the same from the second guide channel 13. Under this condition, the panel holder 7 itself serves as a protective means for preventing breakage at the edges of the glass panel 1 when moving the same to a worksite. In order to shorten the assembly time at the worksite, panel holders 7 can be provided on the top and bottom edges of the glass panel 1 at the workshop before they are transported to the worksite.

Referring to FIGS. 4 to 7, the panel holder 7 with the glass panel 1 is slidably inserted into the second guide channel 13 of the frame member 10 of the present invention. Clearances are formed between the first and second opposed ribs 716, 131 to permit adjustment of the position the panel holder 7 in the second guide channel 13. The panel holder 7 is moved so as to align the elongated groove 780 of the same with the elongated groove 105 of the partition plate 101 in order to maintain the glass panel 1 parallel to the side plate 102 of the frame member 10. Under this condition, the elongated grooves 105, 780 of the partition plate 101 and the panel holder 7 cooperatively define a substantially circular screw receiving hole therebetween. A retaining screw 91 can be inserted into the screw receiving hole in order to temporarily retain the position of the panel holder 7 in the second guide channel 13. The slide piece 20 is moved in the second channel portion 125 of the first guide channel 12 to a desired position in order to align the threaded hole 203 with a threaded hole 103 of the partition plate 101. The locking bolt 9 is inserted from the first guide channel 12 through the opening 122, the threaded hole 203 of the slide piece 20 and into the threaded hole 103 of the partition plate 101. The retaining screw 91 can now be removed with one hand temporarily retaining the position of the panel holder 7. When the locking bolt 9 is screwed, a free end of the locking bolt 9 compresses the top portion of the panel holder 7, thereby correspondingly compressing the first opposed ribs 716 and the extra ribs 717 tightly against the second opposed ribs 131 and the engaging ribs 132 so as to immobilize the panel holder 7 in the second guide channel 13. Under such condition, the glass panel 1 extends parallel to the side plates 102 of the frame member 10. The frame member 10 is then installed to the fixing seat (not shown) provided at the top and bottom ends of a wall opening (not shown) in the building in a conventional manner.

Note that the groove 780 on the top portion of the panel holder 7 should be small enough to prevent the free end of the locking bolt 9 from extending thereinto during the tightening operation thereof.

Figure 2:
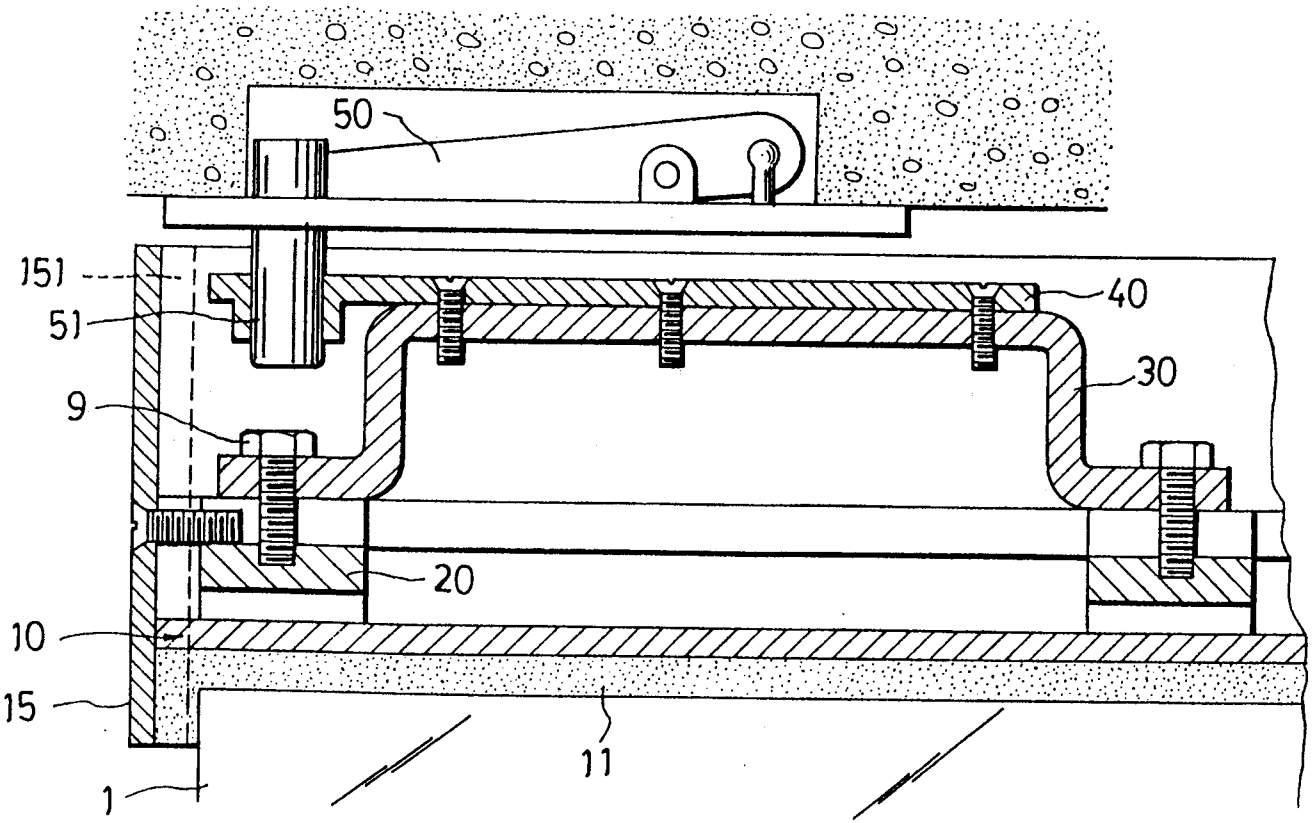
FIG. 2 (PRIOR ART)
FIG. 2 illustrates the conventional door frame when holding a horizontal edge of a glass panel while fixed to a fixing seat of a wall of a building.

From the above description, it has been clearly shown that it is easy and takes a shorter time to install a glass panel in the frame member of the present invention when compared to the conventional frame member shown in FIGS. 1 to 3 due to the particular structure of the panel holder and the second guide channel.

While a preferred embodiment has been explained and described, it will be apparent that many changes and modifications can be made in the general construction and arrangement of the present invention without departing from the scope and spirit thereof. Therefore, it is desired that the present invention be not limited to the exact disclosure but only to the extent of the appended claims.

I claim:

1. A door frame to be mounted at a horizontal edge of a flat panel, said door frame having an H-shaped cross section defined by a pair of vertically-oriented side plates interconnected by a horizontally-oriented partition plate to form first and second guide channels on opposite sides of said partition plate, wherein said door frame further comprises:

a panel holder holding said horizontal edge of said flat panel and having a first engaging unit; and said second guide channel having a second engaging unit detachably engaging said first engaging unit of said panel holder when said panel holder is inserted into said second guide channel;

wherein said panel holder includes two clamping plates located side by side, each of which has a joining portion and a clamping portion formed integrally with said joining portion, said clamping portions of said clamping plates defining a panel receiving space therebetween when said clamping plates are clamped together at said joining portions.

2. The door frame as defined in claim 1, wherein a first one of said clamping plates has a retaining flange which is formed along a topmost edge of said joining portion and which extends toward said joining portion of a second one of said clamping plates, said second one of said remaining clamping plates having an elongated first abutting flange with a flange width that is wider than that of said retaining flange, said first abutting flange extending toward said retaining flange, and a second abutting flange formed on said joining portion of said second one of said remaining clamping plates parallel to and below said first abutting flange, said second abutting flange having a width that is narrower than said flange width of said first abutting flange.

3. The door frame as defined in claim 1 wherein said first engaging unit includes at least a pair of opposed first ribs formed on external faces of said clamping portions of said clamping plates, and said second engaging unit includes at least a pair of opposed second ribs formed on inner surfaces of said side plates and parallel to said partition plate.

4. The door frame as claimed in claim 3, wherein said second engaging unit further includes a pair of engaging ribs extending inwardly into said second guide channel from longitudinal edges of said side plates, each of said engaging ribs having an elongated protrusion formed thereon, said first engaging unit further including a pair of extra ribs formed along a longitudinal edge of each said clamping portion and disposed parallel to said first ribs, each of said extra ribs having an abutting face abutting against said engaging ribs of said second engaging unit and an elongated groove to receive said protrusion of said engaging ribs when said panel holder is inserted slidably into said second guide channel.

5. The door frame as defined in claim 2, wherein said first abutting flange of said second one of said clamping plates abuts against said joining portion of said first one of said clamping plates adjacent to said retaining flange, thereby defining an elongated groove between said retaining flange and said topmost edge of said joining portion of said second one of said remaining clamping plates when said clamping plates are clamped together.

6. The door frame as defined in claim 1, wherein said partition plate further has a longitudinal groove formed substantially along a central line thereof in said second guide channel.

* * * * *